US006702039B2

(12) United States Patent
Parrott et al.

(10) Patent No.: US 6,702,039 B2
(45) Date of Patent: Mar. 9, 2004

(54) PERFORATING GUN CARRIERS AND THEIR METHODS OF MANUFACTURE

(75) Inventors: Robert A. Parrott, Houston, TX (US); Daniel C. Markel, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/108,406

(22) Filed: Mar. 28, 2002

(65) Prior Publication Data

US 2003/0029639 A1 Feb. 13, 2003

Related U.S. Application Data

(60) Provisional application No. 60/345,015, filed on Oct. 29, 2001, and provisional application No. 60/279,996, filed on Mar. 30, 2001.

(51) Int. Cl.[7] ..... E21B 43/11

(52) U.S. Cl. ..... 175/4.6; 166/55; 102/321.1; 72/276; 29/33 D; 29/33 T

(58) Field of Search ..... 175/2, 4.6, 320; 166/55, 297; 102/313, 321, 321.1; 29/33 T, 33 D; 138/177, 171; 83/54; 72/276

(56) References Cited

U.S. PATENT DOCUMENTS

| | | | | |
|---|---|---|---|---|
| 3,201,507 A | * | 8/1965 | Johnsen | 138/149 |
| 4,496,009 A | | 1/1985 | DerMott et al. | |
| 4,534,423 A | | 8/1985 | Regalbuto | |
| 4,598,775 A | | 7/1986 | Vann et al. | |
| 4,739,707 A | | 4/1988 | Regalbuto et al. | |
| 4,803,037 A | * | 2/1989 | McBain et al. | 266/78 |
| 4,915,029 A | * | 4/1990 | Appledorn et al. | 102/313 |
| 4,984,520 A | | 1/1991 | Aseltine et al. | |
| 5,115,707 A | | 5/1992 | Kutzli | |
| 5,213,633 A | * | 5/1993 | Hada et al. | 138/177 |
| 5,590,723 A | | 1/1997 | Walker et al. | |
| 5,701,964 A | | 12/1997 | Walker et al. | |
| 5,803,193 A | * | 9/1998 | Krueger et al. | 175/325.1 |
| 6,024,276 A | * | 2/2000 | Hirata et al. | 228/194 |
| 6,494,261 B1 | * | 12/2002 | Pahmiyer | 166/281 |
| 6,523,474 B2 | * | 2/2003 | Parrott et al. | 102/312 |

FOREIGN PATENT DOCUMENTS

| | | |
|---|---|---|
| DE | 3542681 | 6/1987 |
| EP | 0915420 | 12/1999 |
| GB | 1097571 | 1/1968 |
| GB | 1274194 | 5/1972 |
| GB | 1320186 | 6/1973 |
| JP | 6154815 | 11/1992 |
| JP | 8283852 | 4/1995 |
| WO | WO 98/14689 | 4/1998 |

* cited by examiner

*Primary Examiner*—David Bagnell
*Assistant Examiner*—Matthew J. Smith
(74) *Attorney, Agent, or Firm*—Trop, Pruner & Hu PC; Jeffrey Griffin; Brigitte Jeffrey Echols

(57) ABSTRACT

The subject matter of the present invention relates to perforating gun carriers and their methods of manufacture. In one embodiment of the present invention, high strength, uniform wall thickness carriers are manufactured through use of the electric resistance weld process.

40 Claims, 7 Drawing Sheets

PERFORATING GUN CARRIERS AND THEIR METHODS OF MANUFACTURE

This application claims the benefit of U.S. Provisional Application No. 60/279,996, filed Mar. 30, 2001, and U.S. Provisional Application No. 60/345015, filed Oct. 29, 2001.

FIELD OF THE INVENTION

The subject matter of the present invention relates to perforating gun carriers and their methods of manufacture.

DETAILED DESCRIPTION OF PREFERRED EMBODIMENTS

Figure 1:
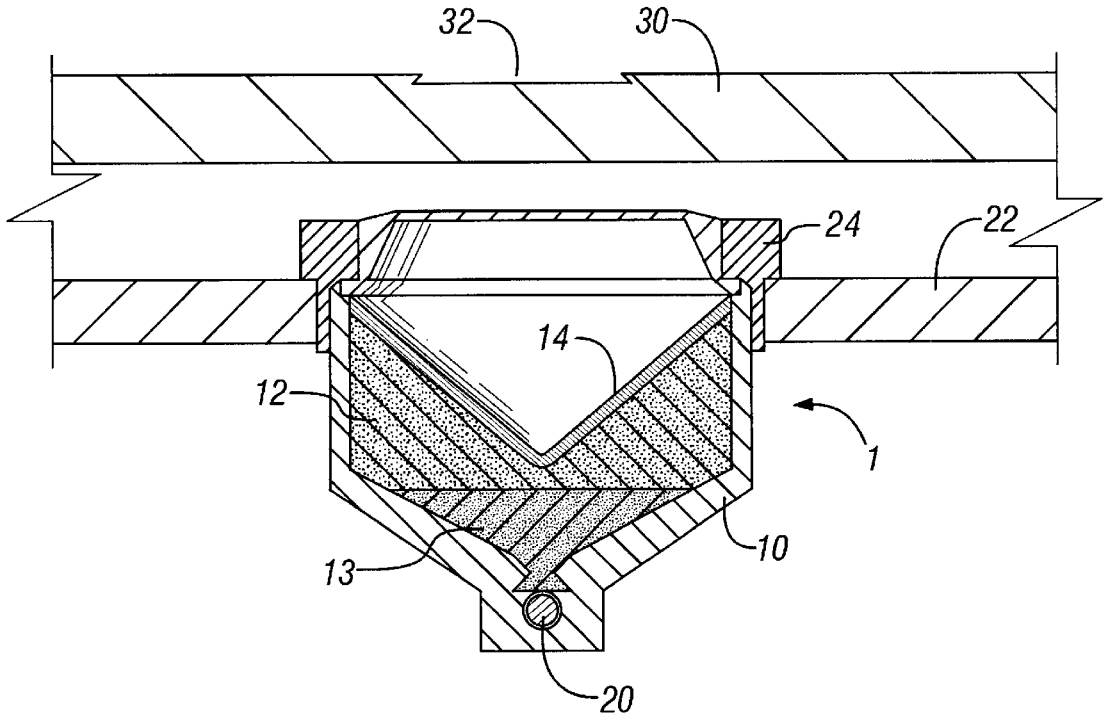
FIG. 1 (Prior Art)
FIG. 1 is a cross-sectional view of a typical shaped charge, loading tube, and perforating gun carrier.
Figure 2:
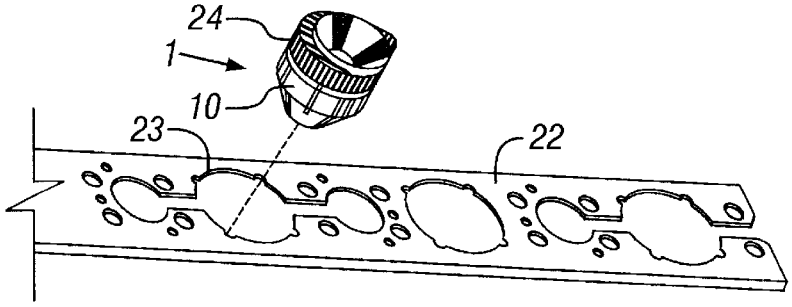
FIG. 2 (Prior Art)
FIG. 2 is a perspective view of a typical shaped charge and loading tube.
Figure 3:
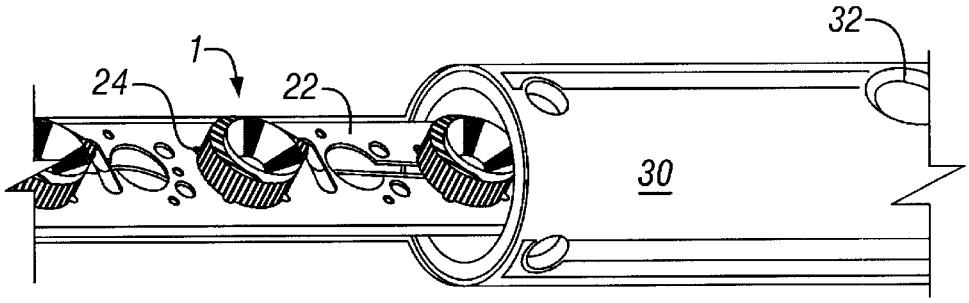
FIG. 3 (Prior Art)
FIG. 3 is a perspective view of a loading tube being inserted into a perforating gun carrier.

FIGS. 1–3 provide an illustration of a typical shaped charge, loading tube, and perforating gun carrier used for perforating a well casing. Typical shaped charges for use in perforating guns are discussed in U.S. Pat. No. 4,724,767 to Aseltine issued Feb. 16, 1988; U.S. Pat. No. 5,413,048 to Werner et al. issued May 9, 1995; U.S. Pat. No. 4,669,384 to Chawla et al. issued Jun. 2, 1987; and again in U.S. Pat. No. 5,597,974 to Voreck, Jr. et al. issued Jan. 28, 1997. Each of the above mentioned disclosures are incorporated by reference into this specification.

A typical shaped charge 1 includes a case 10, a main body of explosive material 12, which in the past has been, for example, RDX, HMX, PYX, HTX, or HNS packed against the inner wall of the case 10, a primer 13 disposed adjacent the main body of explosive 12 that is adapted to detonate the main body of explosive 12 when the primer 13 is detonated, and a liner 14 lining the primer 13 and the main body of explosive material 12. The liner 14 acts to maintain the shape of the explosive to assure proper propagation of the detonation. A detonating cord 20 contacts the case 10 of the shaped charge 1 at a point nearest the apex of the liner 14 of the charge. When a detonation wave propagates within the detonating cord 20, the detonation wave will detonate the primer 13. When the primer 13 is detonated, the detonation of the primer 13 will further detonate the main body of explosive 12 of the charge 1. In response to the detonation of the main body of explosive 12, the liner 14 will form a jet that will propagate along a longitudinal axis of the shaped charge 1.

One or more shaped charges 1 are housed within a loading tube 22 or loading strip for transport. The loading tube 22 can house the shaped charges 1 at desired orientations, or in a linear fashion. A jacket 24, if used, both secures the shaped charges 1 to the loading tube 22 and to maintains the orientation of the shaped charges 1. Once the loading tube 22 is ready for delivery downhole, a perforating gun carrier 30 is used to carry the loading tube 22 and housed shaped charges 1.

In one conventional use, the shaped charges 1 and jackets 24 are inserted into the loading tube 22 until the jackets 24 shoulder against the loading tube shoulders 23. Once all of the shaped charges 1 are secured, the loading tube 22 is inserted into the interior of a perforating gun carrier 30. The gun carrier 30 then transports the shaped charges 1 downhole to the desired depth of perforation.

Upon detonation, the jets from the shaped charges 1 pierce the perforating gun carrier 30, the well casing and the formation penetrated by the wellbore. When the jets pierce the gun carrier 30, they generate circular, jagged pieces of metal ("burrs") that may extend beyond the surface of the gun carrier 30. To minimize any increase in overall diameter of the gun carrier 30, recesses ("scallops") 32 are milled into the outer surface of the gun carrier 30. By aligning the shaped charges 1 such that the generated jets penetrate the recesses 32, the resulting burrs effect on the overall diameter of the gun carrier 30 is reduced by the depth of the recesses 32.

Figure 4:
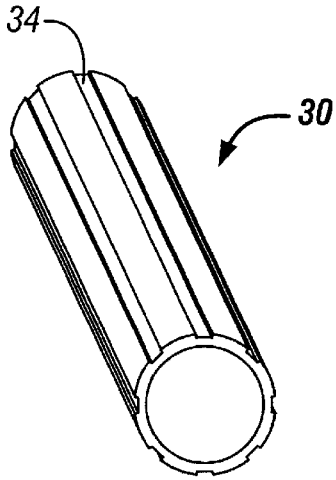
FIG. 4 is a perspective view of a perforating gun carrier made by machining longitudinal grooves into the outer surface of the carrier.

As shown in FIG. 4, one embodiment of the present invention provides a method of minimizing any increase in overall diameter of the gun carrier 30 resulting from the burrs generated by the shaped charge jets. In this method, grooves 34 are machined into the gun carrier 30 by extruding the gun carrier 30 through dies in either a cold-working or a hot-working process. The width and angles of the grooves 34 are extruded to match the desired gun pattern. The grooves 34 are located where the jets of the shaped charges 1 are intended to exit the gun carrier 30.

Figure 5:
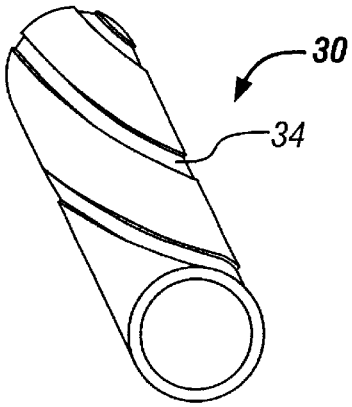
FIG. 5 is a perspective view of a perforating gun carrier made by machining spiral grooves into the outer surface of the carrier.
Figure 6A:
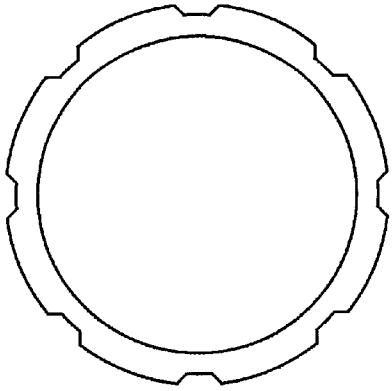
FIGS. 6*a*–6*f* are side views of exemplary embodiments of perforating gun carriers having machined grooves.
Figure 6B:
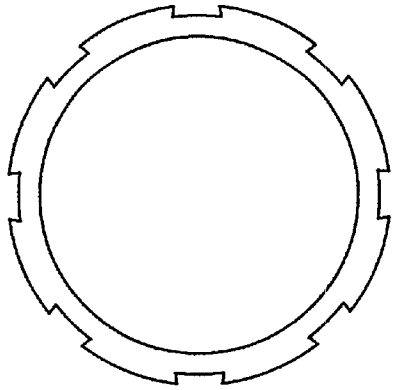
Figure 6C:
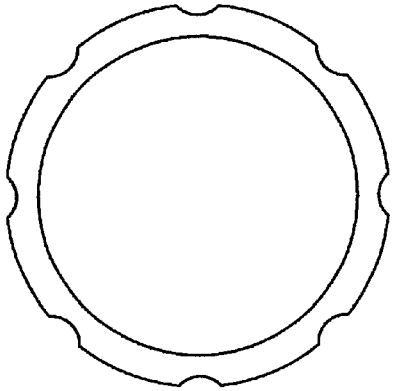
Figure 6D:
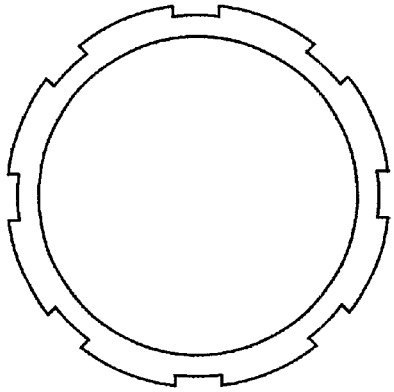
Figure 6E:
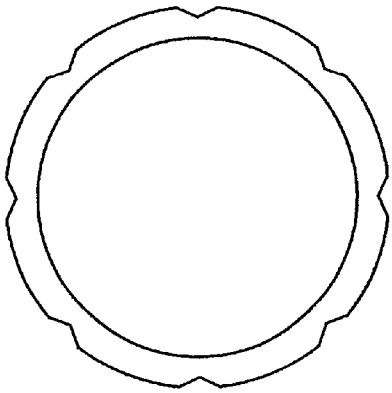
Figure 6F:
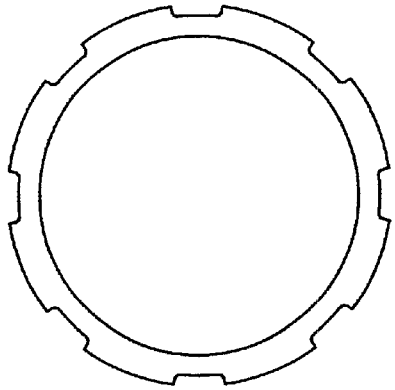

In the embodiment shown in FIG. 4, the grooves 34 extend longitudinally along the length of the gun carrier 30. However, the grooves 34 can be extruded in alternate patterns such as helical or spiral, for example. FIG. 5 illustrates spiral grooves 34 extending along the length of the gun carrier 30. Further, as shown in FIGS. 6*a*–6*e*, the grooves 34 may be extruded in any number of geometries. As examples, FIG. 6*a* provides beveled edge grooves, FIG. 6*b* provides dove tail shaped grooves, FIG. 6*c* provides curved grooves, FIG. 6*d* provides flat grooves, FIG. 6*e* provides v-shaped grooves, and FIG. 6*f* provides radiused corner grooves.

Figure 7:
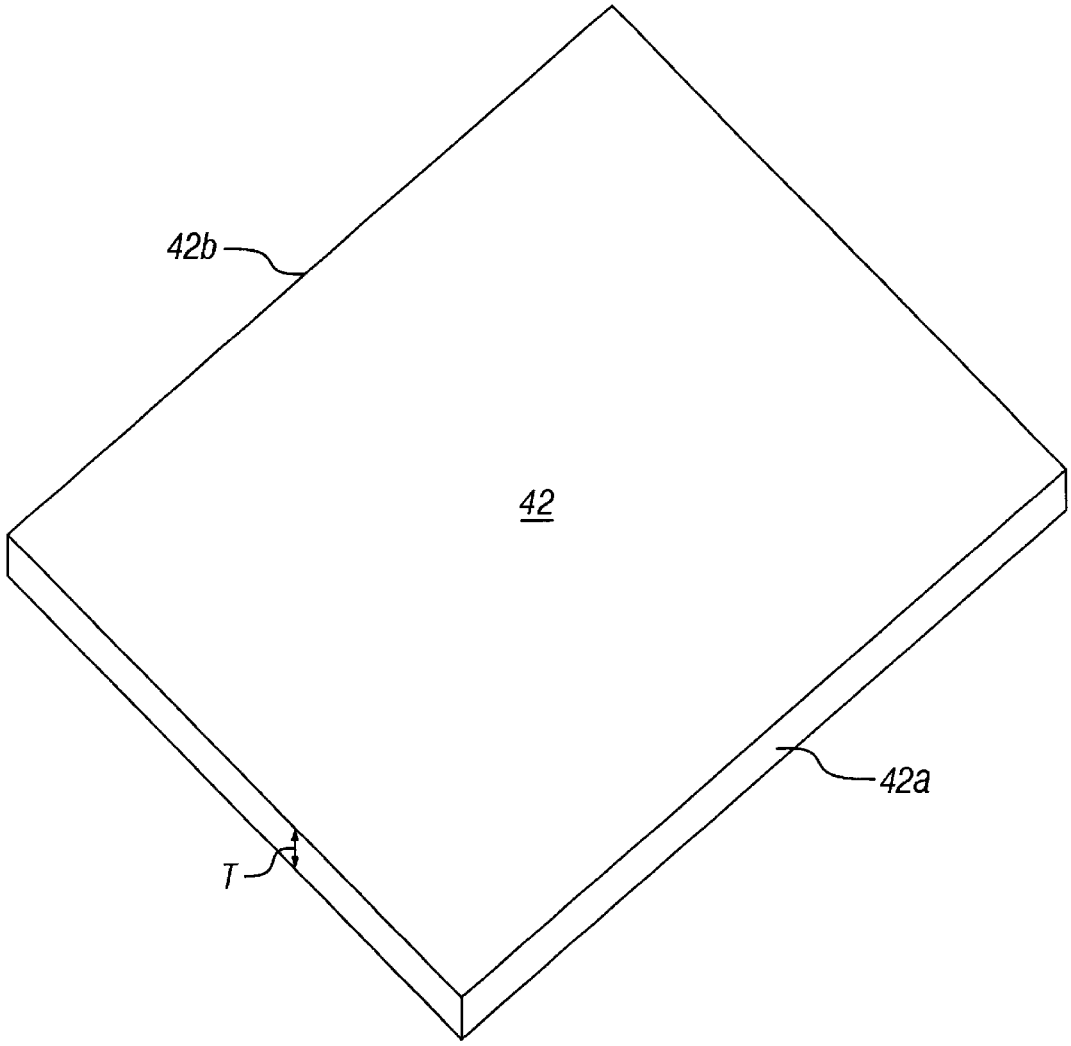
FIG. 7 is a perspective view of flat sheet metal stock used in an embodiment of the electric resistance weld manufacture of a perforating gun carrier.
Figure 8:
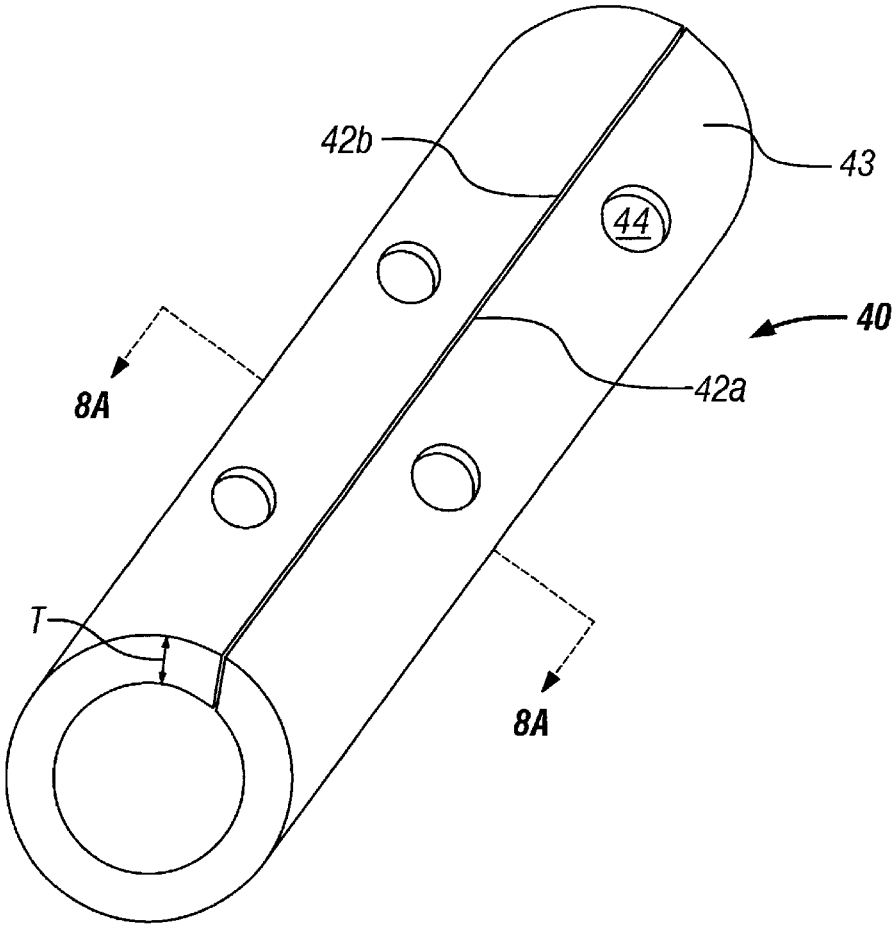
FIG. 8 is a perspective view of a high strength perforating gun carrier made by an embodiment of the electric resistance weld manufacturing method. Recesses are milled into the gun carrier.
Figure 9:
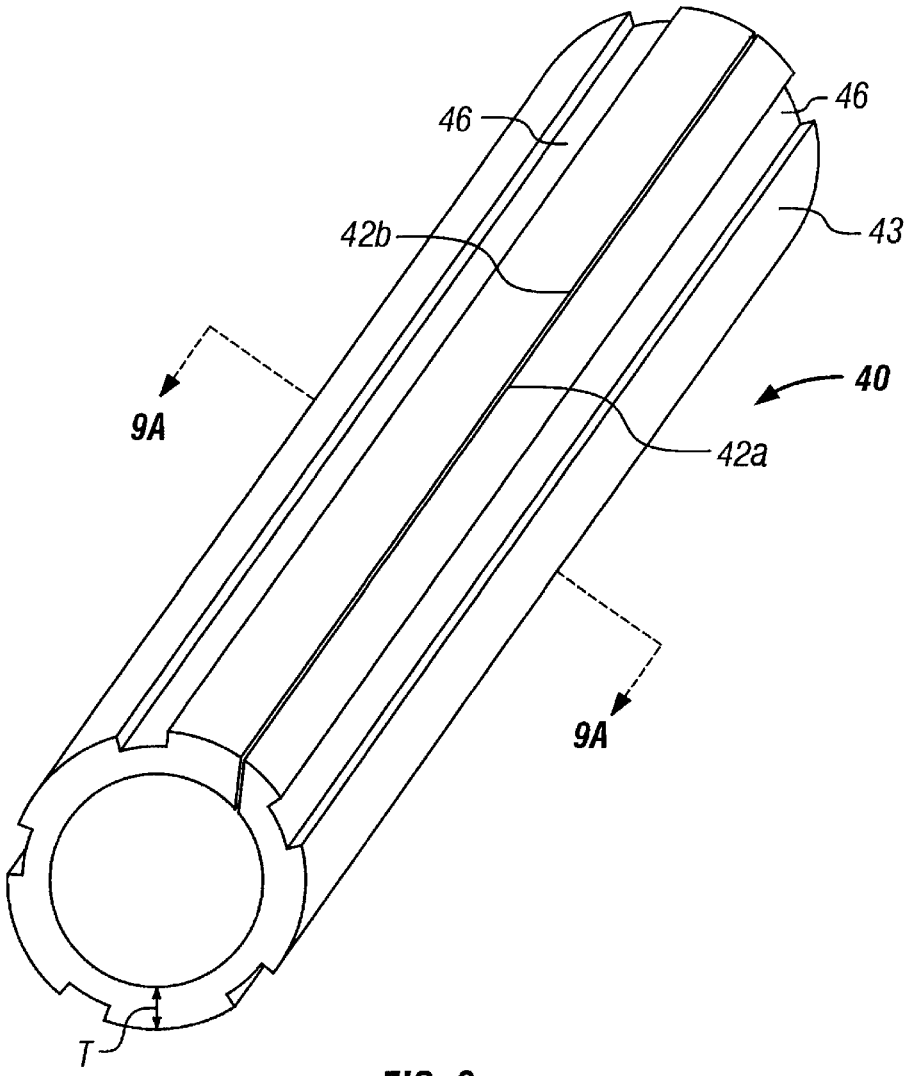
FIG. 9 is a perspective view of a high strength perforating gun carrier made by an embodiment of the electric resistance weld manufacturing method. Grooves are extruded from the gun carrier.

With reference to FIGS. 7–9, an embodiment of the manufacture of alloy steel tubing for use as a perforating gun carrier 40 is detailed. The alloy steel tubing is manufactured by the electric resistance weld (ERW) method. Flat sheet metal stock 42 of the alloy steel is first rolled into a hollow tube 43. Subsequently, the ends 42*a*, 42*b* of the sheet metal stock 42 are welded using ERW techniques to complete the tube 43. Finally, the hollow tube 43 is stretched and reduced, and heat treated (quenched and tempered). The end result is an alloy steel tube 43 for use as a perforating gun carrier 40 that has strength and toughness characteristics similar to heat treated alloy steel tubing produced by either a "hot finished" or "cold drawn" process, and has low wall thickness variations similar to plain carbon steel tubing manufactured by the ERW method.

Typically, to complete the manufacture of the high strength, uniform thickness perforating gun carrier 40, recesses 44 (shown in FIG. 8) are machined into the outer surface of the gun carrier 40. The recesses 44 are formed on the outer surface of the gun carrier 40 by conventional milling. In an alternate embodiment, shown in FIG. 9, grooves 46 are formed on the outer surface of the gun carrier 40 by the extrusion process detailed above.

Figure 8A:
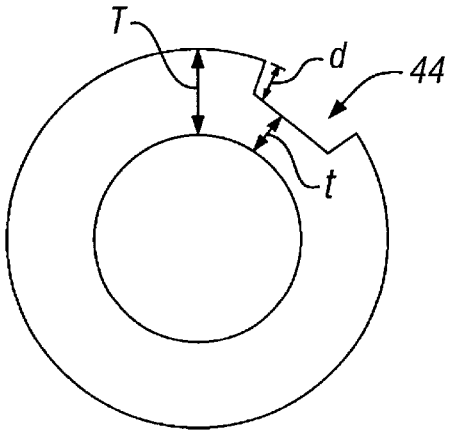
FIG. 8*a* is a cross-sectional view of the gun carrier of FIG. 8 taken along the line a—a.
Figure 9A:
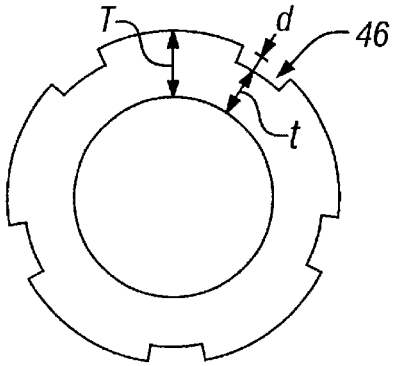
FIG. 9*a* is a cross-sectional view of the gun carrier of FIG. 9 taken along the line a—a.

As best seen in FIGS. 8*a* and 9*a*, cross-sectional views taken along the lines 8A and 9A of FIGS. 8 and 9, respectively, the wall thickness T, less the depth of the recess d, is the web thickness t. It is the web thickness t that the shaped charge jet must pass through when the shaped charge detonates. Because the wall thickness T of the high strength, uniform thickness perforating gun carrier 40 is substantially uniform, the recesses 44 can be machined into the wall of the carrier 40 to more consistently generate a uniform web thickness t. A uniform web thickness t provides more consistent shape charge performance, allowing the shaped charge to be more effectively optimized for highest performance.

If the high strength, uniform thickness perforating gun carrier 40 is being used as a deep penetrator perforating gun carrier, it is not necessary to have machined recesses or grooves in the carrier wall through which the shaped charge jet. In such instances, the objective is to provide maximum hole size in the casing that is shot. It is desirable to have a minimum of the jet material absorbed by the wall of the gun carrier 40 to provide a maximum of jet material to strike the wellbore casing. Clearly, variations in the wall thickness T can have an adverse effect on the performance of the shaped charge. If the wall thickness T is too thick, some of the high energy portion of the jet must be used to penetrate the gun carrier 40, resulting in a smaller casing entrance hole. Likewise, if the wall thickness T is too thin, some of the smaller portion of the jet survives the penetration of the gun carrier 40 and enters the casing, also resulting in a smaller casing entrance hole. Thus, in deep penetrator applications, specific importance is placed on the perforating gun carrier 40 having a low variation in wall thickness T.

Figure 10:
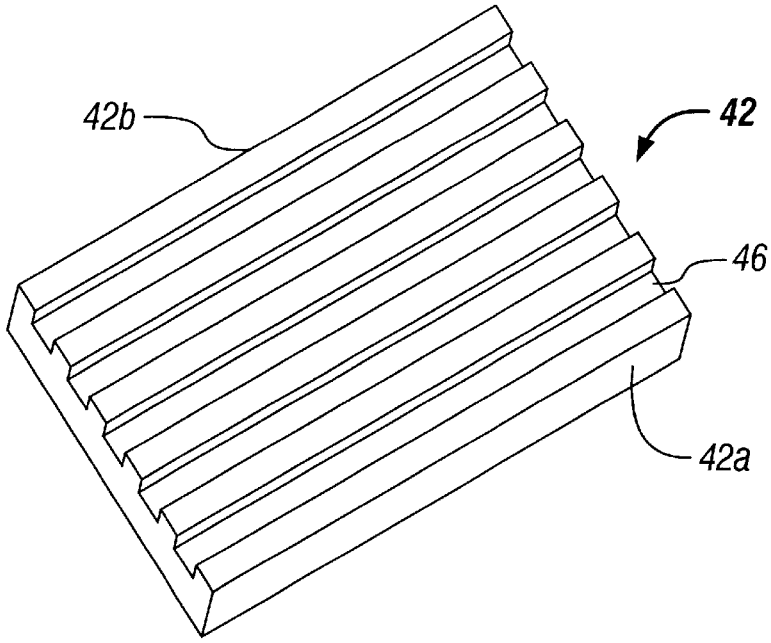
FIG. 10 is a perspective view of flat sheet metal stock used in an embodiment of the electric resistance weld manufacture of a perforating gun carrier. Grooves have been extruded from the sheet metal stock.
Figure 11:
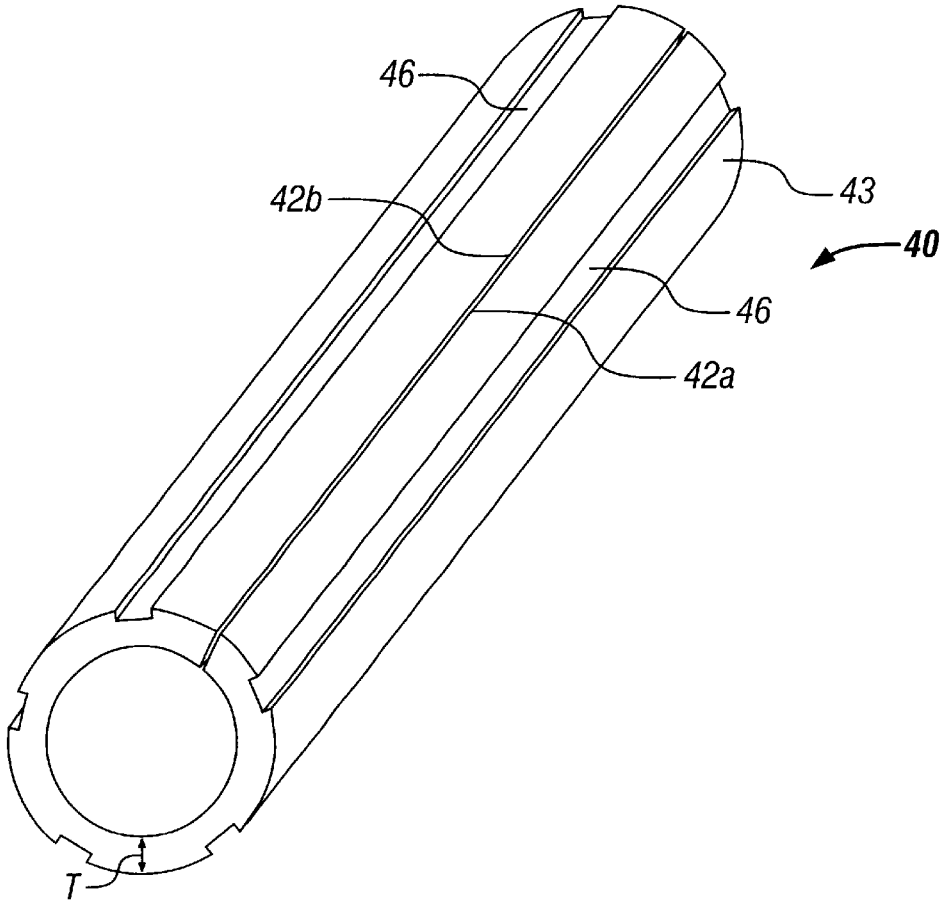
FIG. 11 is a perspective view of a high strength perforating gun carrier made by an embodiment of the electric resistance weld manufacturing method.

FIGS. 10 and 11 illustrate yet another embodiment of the manufacture of alloy steel tubing for use as a perforating gun carrier 40. As above, the alloy steel tubing is manufactured by the ERW method. However, in this embodiment, grooves 42 are extruded from the flat sheet metal stock 42 prior to rolling into a hollow tube 43.

EXAMPLE 1

The following example compares the performance of gun carriers made from conventional hot finished mechanical tubing with the performance of the high strength, uniform wall thickness gun carriers 40 made by the ERW method discussed above. For purposes of illustration, the gun carriers in the example have a wall thickness T of 0.500 inches and a recess depth d machined to 0.280 inches. It should be noted that the example applies equally to embodiments of gun carriers 40 having grooves 46 extruded by the methods detailed above.

1) Conventional hot finished gun carrier. Conventional gun carriers are made from hot finished mechanical tubing. The wall thickness T of a conventional gun carrier has a variance of approximately 10 percent. Thus, in the present example, the resulting thickness T ranges between 0.450 inches and 0.550 inches. The recess depth d of 0.280 inches is machined with a variance of 0.010 inches. The resulting range of the recess depth d is between 0.270 and 0.290 inches. Thus, the web thickness t that the shaped charge jet must shoot through varies between 0.160 inches and 0.280 inches. The variance range of the web thickness t is 0.120 inches.

2) Alloy Steel ERW Gun Carrier. By contrast, the high strength, uniform wall thickness gun carrier 40 manufactured by the ERW method discussed above has a wall thickness T having a variance of approximately 4 percent. The resulting thickness T ranges between 0.480 inches and 0.520 inches. The recess depth d is again machined to 0.280 inches with a variance of 0.010 inches. Thus, the web thickness t that the shaped charge jet must shoot through varies between 0.190 inches and 0.250 inches. The variance range of the web thickness t of 0.060 inches is half the range of the conventional gun carrier web thickness t.

The above discussed data of Example 1 is provided in tabular form in Table I below.

TABLE I

Conventional v. ERW Gun Carrier Web Thickness

| | Conventional Carrier | Allow Steel ERW Carrier |
|---|---|---|
| Thickness (T) (in.) | 0.500 | 0.500 |
| T Range (in.) | 0.450–0.550 | 0.480–0.520 |
| Recess Depth (d) (in.) | 0.280 | 0.280 |
| d Range (in.) | 0.270–0.290 | 0.270–0.290 |
| Web Thickness (t) Range (in.) | 0.160–0.280 | 0.190–0.250 |
| Variance Range (in.) | 0.120 | 0.060 |

Another embodiment of manufacture of alloy steel tubing for use as a perforating gun carrier 40 utilizes the ERW method of manufacture described above. However, in this embodiment, after heat treating (quenching and tempering), the material of the hollow tube 43 is cold worked through the drawn over mandrel or cold drawing process to further increase the strength of the material. Subsequently, the material of the hollow tube 43 is stress relieved or tempered to generate a high level of toughness.

In addition to improving the strength and toughness of the material, the subsequent cold working and stress relieving also increases the uniformity of the OD and ID dimensions of the perforating gun carrier 40. The associated highly uniform bending moments of inertia enable the gun carrier 40 to be used in gun strings which must be aligned or oriented in a bent wellbore without adversely turning the gun string out of orientation.

Once again, the manufacture of the high strength perforating gun carrier 40 is completed by machining recesses 44, or grooves 46, into the outer surface of the gun carrier 40.

EXAMPLE 2

The following example compares the performance of high strength, uniform thickness gun carriers made from: 1) The ERW process without subsequent cold working and stress relieving; and 2) The ERW process with subsequent cold working and stress relieving.

1) ERW Process Without Subsequent Cold Working and Stress Relieving. As detailed in Example 1, the high strength gun carrier 40 made by the ERW process has a wall thickness T of 0.500 inches with a variance of 4 percent. The resulting thickness T ranges between 0.480 inches and 0.520 inches. The recess depth d is again machined to 0.280 inches with a variance of 0.010 inches. Thus, the web thickness t that the shaped charge jet must shoot through varies between 0.190 inches and 0.250 inches. The variance range of 0.060 inches is half the range of the conventional gun carrier web thickness t.

2) ERW Process With Subsequent Cold Working And Stress Relieving. The high strength, uniform wall thickness gun carrier 40 made by the ERW process with subsequent cold working and stress relieving has a wall thickness T of 0.500 inches with a variance of 2 percent. The resulting thickness T ranges between 0.490 inches and 0.510 inches. The recess depth d is again machined to 0.280 inches with a variance of 0.010 inches. Thus, the web thickness t that the shaped charge jet must shoot through varies between 0.200 inches and 0.240 inches. The variance range of 0.040 inches is one-third the range of the conventional gun carrier web thickness t and two-thirds the range of the ERW process without cold working web thickness.

The above discussed data of Example 2 is provided in tabular form in Table II below.

TABLE II

ERW Carrier v. Cold Worked ERW Carrier

| | Conventional Carrier | Alloy Steel ERW Carrier | Alloy Steel ERW Carrier (cold worked) |
|---|---|---|---|
| Thickness (T) (in.) | 0.500 | 0.500 | 0.500 |
| T Range (in.) | 0.450–0.550 | 0.480–0.520 | 0.490–0.510 |
| Recess Depth (d) (in.) | 0.280 | 0.280 | 0.280 |
| d Range (in.) | 0.270–0.290 | 0.270–0.290 | 0.270–0.290 |
| Web Thickness (t) Range (in.) | 0.160–0.280 | 0.190–0.250 | 0.200–0.240 |
| Variance Range (in.) | 0.120 | 0.060 | 0.040 |

The invention being thus described, it will be obvious that the same may be varied in many ways. Such variations are not to be regarded as a departure from the spirit and scope of the invention, and all such are intended to be included within the scope of the following non-limiting claims.

What is claimed is:

1. A method of forming a perforating gun carrier, comprising:

(a) rolling a sheet of alloy steel into a hollow tube of the perforating gun carrier;

(b) welding the edges of the sheet metal stock to complete the tube;

(c) stretching and reducing the tube to obtain the desired diameter and wall thickness; and (d) heat treating the tube to obtain the desired mechanical properties.

2. The method of claim 1, wherein the welding is performed with an electric resistance weld technique.

3. The method of claim 1, further comprising machining recesses into the exterior of the alloy steel tube.

4. The method of claim 3, wherein the recesses are milled into the exterior of the tube.

5. The method of claim 1, further comprising forming grooves in the exterior of the tube.

6. The method of claim 5, wherein the grooves are formed by extruding the tube through dies.

7. The method of claim 5, wherein the grooves are formed by extruding the flat sheet metal stock through dies prior to rolling.

8. A method of forming a perforating gun carrier, comprising:

(a) rolling a sheet of alloy steel into a hollow tube of the perforating gun carrier, (b) welding the edges of the sheet metal stock to complete the alloy steel tube;

(c) stretching and reducing the alloy steel tube to obtain the desired diameter and wall thickness;

(d) heat treating the alloy steel tube to obtain the desired mechanical properties;

(e) cold working the alloy steel tube; and (f) relieving stress from the alloy steel tube.

9. The method of claim 8, wherein the welding is performed with an electric resistance weld technique.

10. The method of claim 8, wherein the cold working is a drawn over mandrel process.

11. The method of claim 8, wherein the cold working is a cold drawing process.

12. The method of claim 8, further wherein the alloy steel tube is tempered to relieve stress.

13. The method of claim 8, further comprising machining recesses into the exterior of the alloy steel tube.

14. The method of claim 13, wherein the recesses are milled into the exterior of the tube.

15. The method of claim 8, further comprising forming grooves in the exterior of the tube.

16. The method of claim 15, wherein the grooves are formed by extruding the tube through dies.

17. The method of claim 15, wherein the grooves are formed by extruding the flat sheet metal stock through dies prior to rolling.

18. A high strength, alloy steel perforating gun carrier made by a process, comprising:

(a) rolling flat sheet metal stock into a hollow alloy steel tube of the perforating gun carrier;

(b) welding the edges of the sheet metal stock to complete the alloy steel tube;

(c) stretching and reducing the alloy steel tube to obtain the desired diameter and wall thickness; and (d) heat treating the alloy steel tube to obtain the desired mechanical properties.

19. The high strength, perforating gun carrier of claim 18, wherein the welding is performed with an electric resistance weld technique.

20. The high strength, perforating gun carrier of claim 18, wherein the process further comprises cold working the alloy steel tube.

21. The high strength, perforating gun carrier of claim 20, wherein the process further comprises relieving stress from the alloy steel tube.

22. The method of claim 18, further comprising forming grooves in an exterior surface of the tube.

23. The method of claim 22, wherein the grooves are formed by extruding the tube through dies.

24. The method of claim 22, wherein the grooves are formed by extruding the flat sheet metal stock through dies prior to rolling.

25. A method of minimizing wail thickness variations and increasing strength and toughness in gun carriers for use in a well, the method comprising:

(a) rolling a sheet of alloy steel into a hollow tube of a gun carrier;

(b) welding the edges of the sheet metal stock to complete the alloy steel tube, the welding performed with an electric resistance weld;

(c) stretching and reducing the alloy steel tube to obtain desired diameter and wall thickness;

(d) heat treating the alloy steel tube to obtain the desired mechanical properties;

(e) cold working the alloy steel tube; and (f) stress relieving the alloy steel tube.

26. The method of claim 25, further comprising forming grooves in an exterior surface of the tube.

27. The method of claim 26, wherein the grooves are formed by extruding the tube through dies.

28. The method of claim 26, wherein the grooves are formed by extruding the flat sheet metal stock through dies prior to rolling.

29. A perforating gun carrier, comprising:

a tube to house shaped charges, the tube having one or more exterior grooves extending along the length of the tube.

30. The gun carrier of claim 29, wherein the grooves are extruded.

31. The gun carrier of claim 29, wherein the grooves extend longitudinally along the length of the tube.

32. The gun carrier of claim 29, wherein the grooves form a spiral pattern on the exterior of the tube.

33. The gun carrier of claims 29, wherein the grooves form a helical pattern on the exterior of the tube.

34. The gun carrier of claim 29, wherein the tube is a rolled alloy steel tube.

35. The gun carrier of claim 34, wherein the rolled alloy steel tube is formed by the electric resistance weld process.

36. The perforating gun carrier of claim 29, wherein at least one of said one or more exterior grooves is positioned to coincide with jets formed by shaped charges located inside the tube.

37. A method of forming grooves in a perforating gun carrier, comprising:

(a) making a die; and (b) extruding the gun carrier through the die.

38. A method of using a high strength, uniform thickness gun carrier in a well, the method comprising:

providing a high strength, uniform thickness perforating gun carrier comprising a rolled alloy steel tube;

forming grooves in an exterior surface of the tube; and conveying the high strength, uniform thickness perforating gun carrier downhole.

39. The method of claim 38, wherein the grooves are formed by extruding the tube through dies.

40. The method of claim 38, wherein the tube is formed by rolling flat sheet metal stock, and the grooves are formed by extruding the flat sheet metal stock through dies prior to rolling.

* * * * *